US005924386A

United States Patent [19]

Lewis

[11] Patent Number: 5,924,386

[45] Date of Patent: Jul. 20, 1999

[54] JUMPS FOR HORSES

[76] Inventor: Martin Peter Lewis, Yearling Coppice Farm, Otford Lane, Halstead, Nr. Sevenoaks, Kent, United Kingdom, TN14 7EQ

[21] Appl. No.: 08/737,859

[22] PCT Filed: May 19, 1995

[86] PCT No.: PCT/GB95/01132

§ 371 Date: Nov. 15, 1996

§ 102(e) Date: Nov. 15, 1996

[87] PCT Pub. No.: WO95/32039

PCT Pub. Date: Nov. 30, 1995

[30] Foreign Application Priority Data

May 20, 1994 [GB] United Kingdom ..... 9410145

[51] Int. Cl.[6] ..... A63K 3/04

[52] U.S. Cl. ..... 119/705; 472/86; 482/15

[58] Field of Search ..... 119/705; 482/15–17, 482/35–38, 16, 81; 472/86, 87, 85; 49/29, 58

[56] References Cited

U.S. PATENT DOCUMENTS

| | | | |
|---|---|---|---|
| 1,902,995 | 3/1933 | Flynn | 119/705 |
| 2,236,935 | 4/1941 | Cameron | 482/17 |
| 2,279,539 | 4/1942 | Vogt et al. | 119/705 |
| 3,637,204 | 1/1972 | Dawson | 482/17 |
| 4,739,985 | 4/1988 | Rudell et al. | 482/81 |
| 5,152,727 | 10/1992 | Moore et al. | 482/15 |
| 5,256,116 | 10/1993 | Robinson | 482/37 |
| 5,549,195 | 8/1996 | Aulagner et al. | 482/37 |

FOREIGN PATENT DOCUMENTS

| | | | |
|---|---|---|---|
| 2712820 | 6/1995 | France . | |
| 54-44939 | 4/1979 | Japan | 482/15 |
| 1512634 | 10/1989 | U.S.S.R. | 482/17 |
| 93/24197 | 12/1993 | WIPO | 119/705 |

*Primary Examiner*—Richard J. Apley
*Assistant Examiner*—Victor K. Hwang
*Attorney, Agent, or Firm*—Darby & Darby

[57] ABSTRACT

Jumps for horses comprise control means for altering with elapse of time at least one of the shape, configuration and position relative to the ground of the obstacle presented by the jump to the horse. Examples of obstacles presented of which at least one of the shape, configuration and position relative to the ground are caused to vary are an axially rotatable beam with a non-circular cross-section, water issued from a plurality of selectively controllable water jet nozzles, and a plurality of mutually parallel poles mounted to be driven in a direction perpendicular to their length along a closed loop, which itself moves along the ground.

21 Claims, 8 Drawing Sheets

JUMPS FOR HORSES

BACKGROUND OF THE INVENTION

1. Field of the Invention

This invention relates to jumps for horses, and has application to such jumps for showjumping competitions.

2. Discussion of the Related Art

Existing showjumping courses employ a number of jumps consisting of a static obstacle with one or more components which can be knocked loose if struck by a horse. As a variant, known jumps comprise water filled ditches. Scoring includes the award of penalties when a horse knocks loose a component and/or comes into contact with the water of a jump. The scope for varying the design of such jumps is limited. To increase interest in the sport, progressively higher and more intimidating jumps have been used. However, it is difficult to reconcile such developments with the overriding need for safety of both horse and rider, and, in particular, the increase in jump height greatly increases the physical strain and risk of injury to horses.

SUMMARY OF THE INVENTION

There is therefore a need to provide jumps for horses which capture the interest of spectators and riders without compromising the safety and good health of the horses.

According to one aspect of the invention there is provided a jump for horses which is non static and comprises means for altering with elapse of time, the shape and/or configuration of the obstacle presented by the jump to a horse.

According to another aspect of the present invention, there is provided a jump which is non static and comprises means for altering with elapse of time, the position of the obstacle presented by the jump to the horse relative to the ground.

One embodiment of the jump comprises a plurality of water jet nozzles from which water issues to constitute said obstacle. Valve control means are provided to alter with time, the shape and configuration of the obstacle by selectively controlling issue of water from the jets.

In another embodiment, the jump comprises an axially rotatable beam whose cross-section is non-circular and which defines said obstacle. Drive means are provided to rotate the beam about its axis thereby altering the shape and configuration of the obstacle presented to the horse.

In a further embodiment of the invention, means are provided for altering with elapse of time, the shape and/or configuration of the obstacle presented to the horse and also the position of that obstacle relative to the ground. In one such embodiment means are provided to move a plurality of mutually parallel elongate elements defining said obstacle in a direction perpendicular to their length along a closed loop which itself moves along the ground.

A preferred feature of embodiments of the invention is the provision of display means to indicate whether the jump has been attempted. Preferably, such display means are turned on when a sensor detects the proximity of a horse attempting the jump. A suitable sensor for this purpose is an infra-red thermal detector.

A further preferred feature of embodiments of the invention is the provision of a second display means to provide an indication of the current physical state of the jump. Such second display means are preferably configured to provide an indication of the present difficulty of the jump so as to assist a rider in determining when to attempt the jump.

In preferred embodiments of the invention, remote control means are provided for remote operation of the means for altering the shape and/or configuration, or the position, of the jump with elapse of time. Advantageously, these altering means are programmed/programmable enabling the shape and/or configuration, or the position, of the jump to be altered in a predetermined manner.

BRIEF DESCRIPTION OF THE DRAWING FIGURES

Embodiments of the invention are described below, by way of example, with reference to the accompanying drawings, in which.

Figure 1:
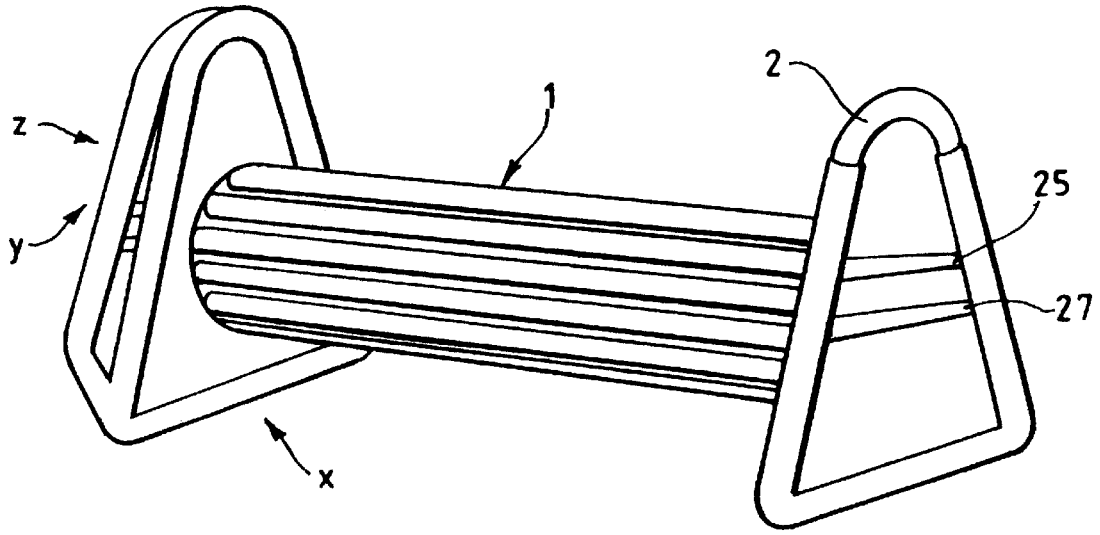
FIG. 1 shows a schematic perspective view of an embodiment of a jump according to the invention.
Figure 5:
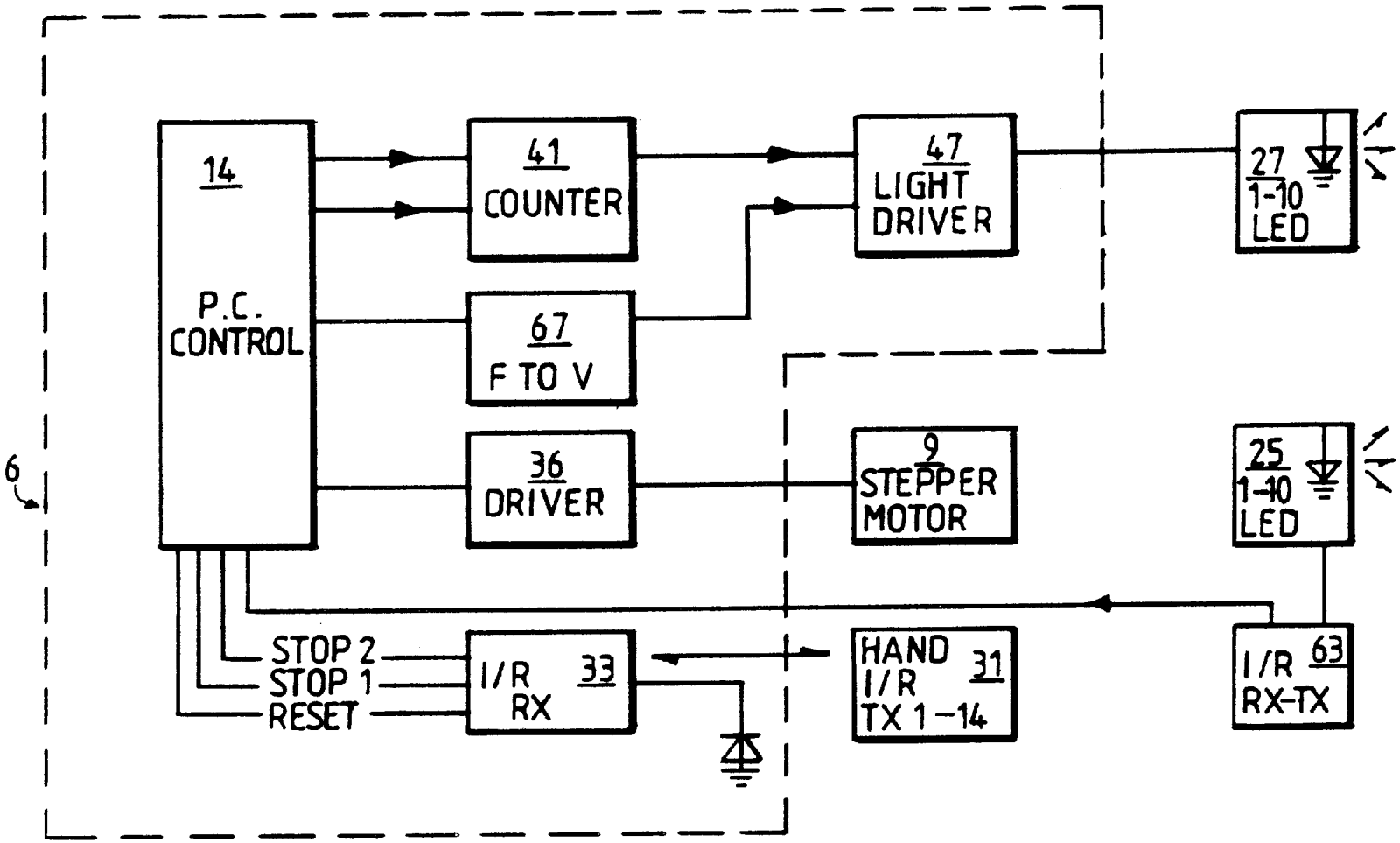
Figure 6:
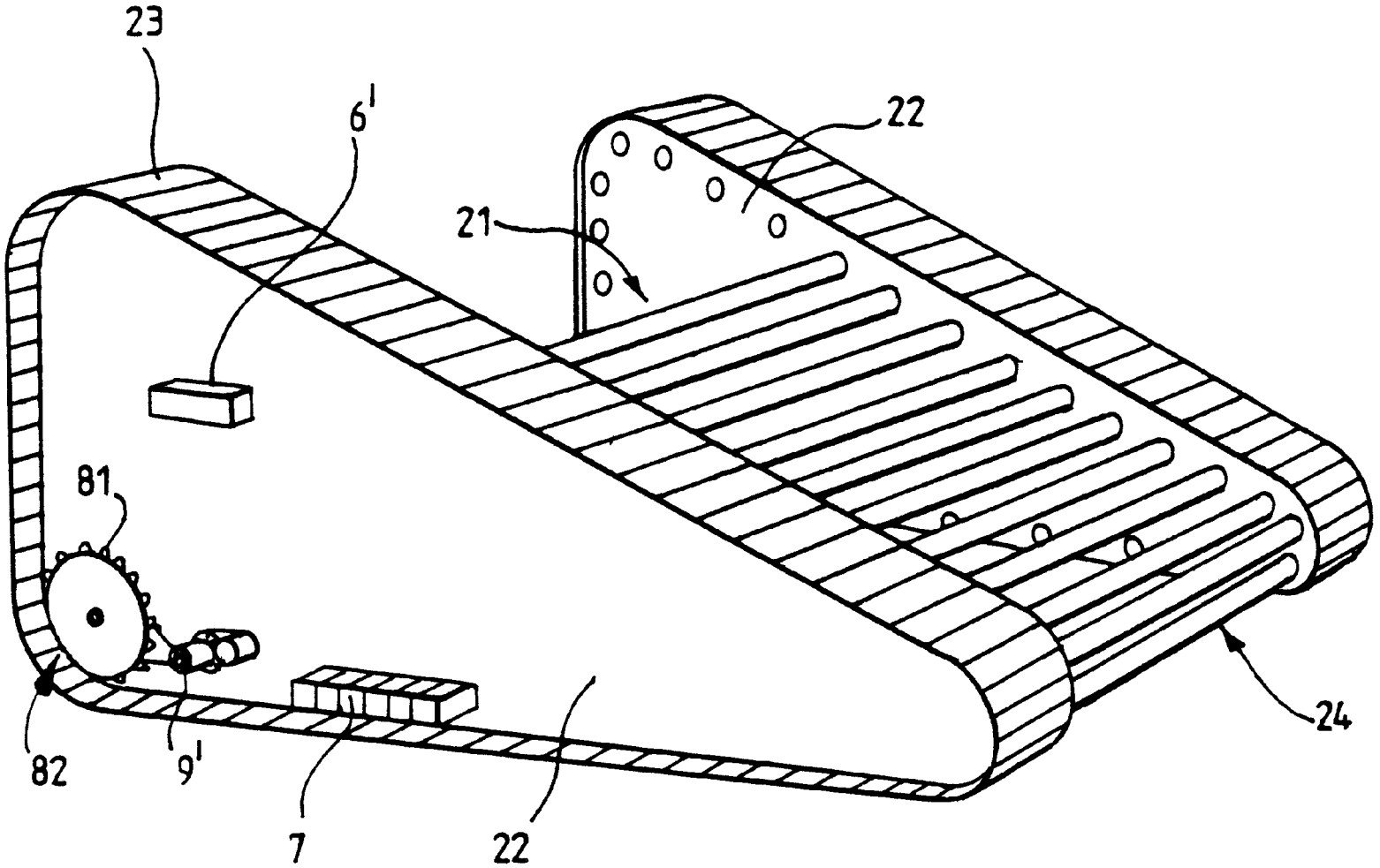
Figure 7:
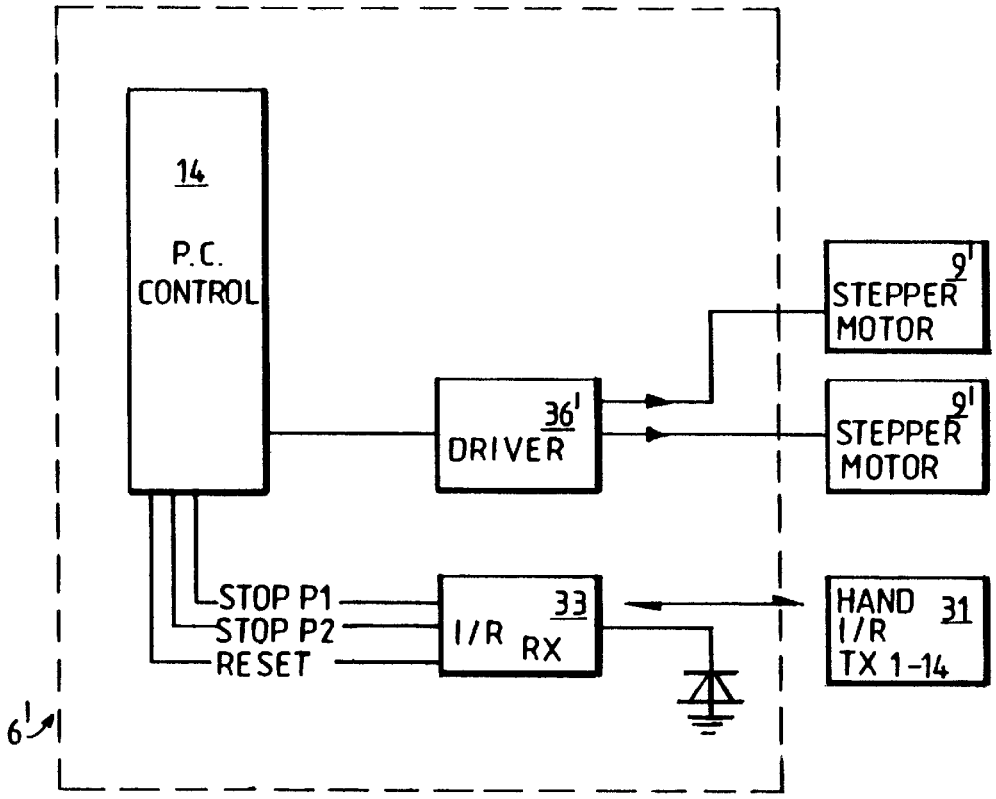
Figure 8:
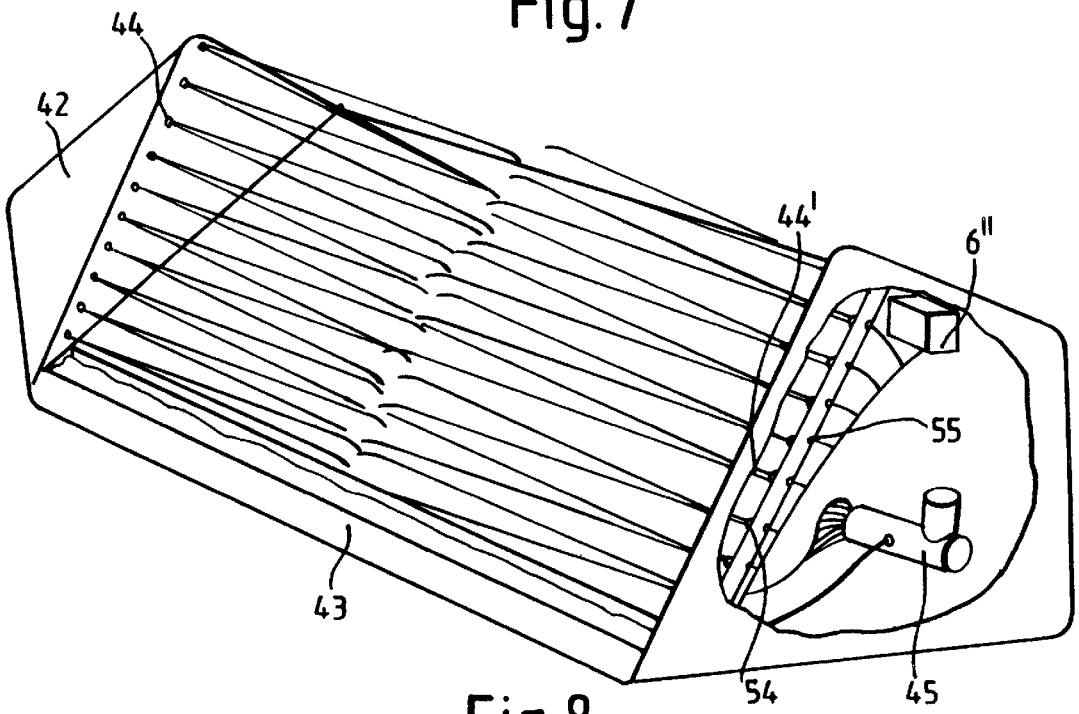
Figure 9:
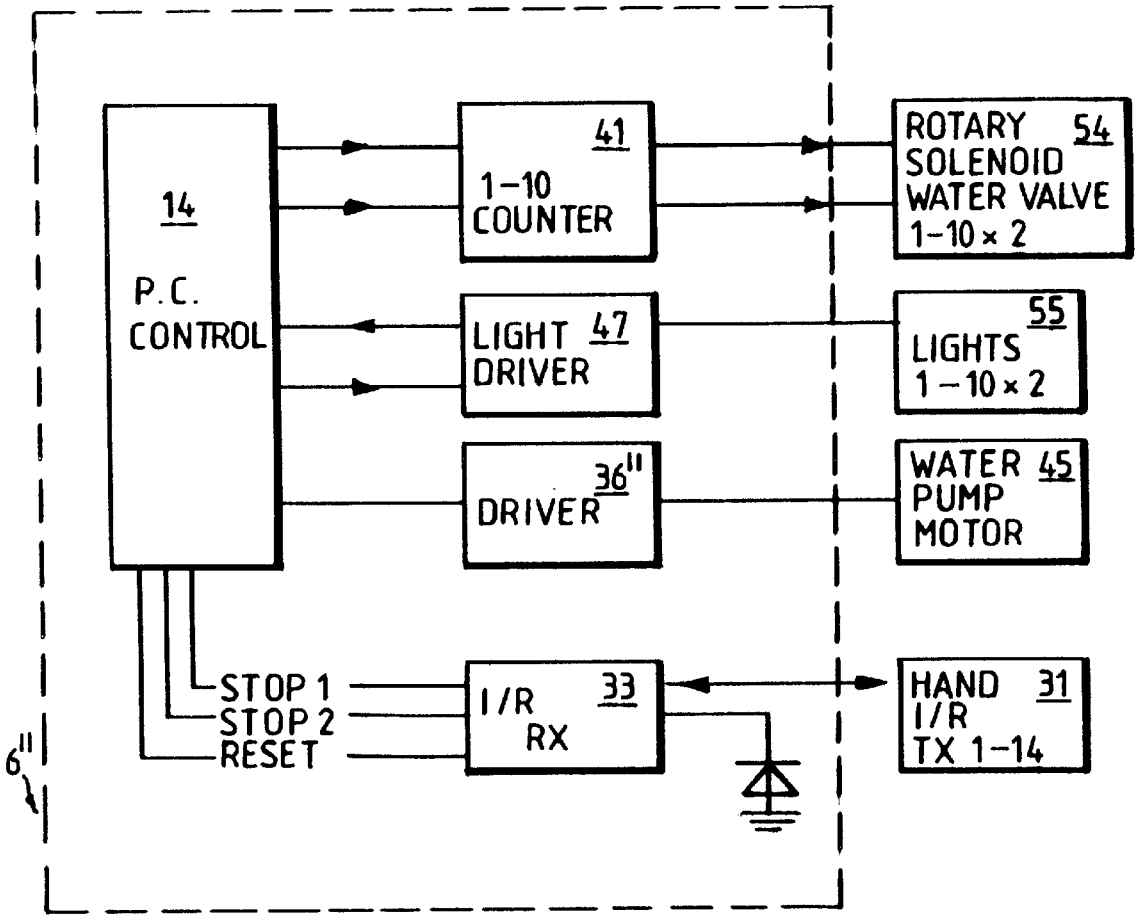
Figure 10:
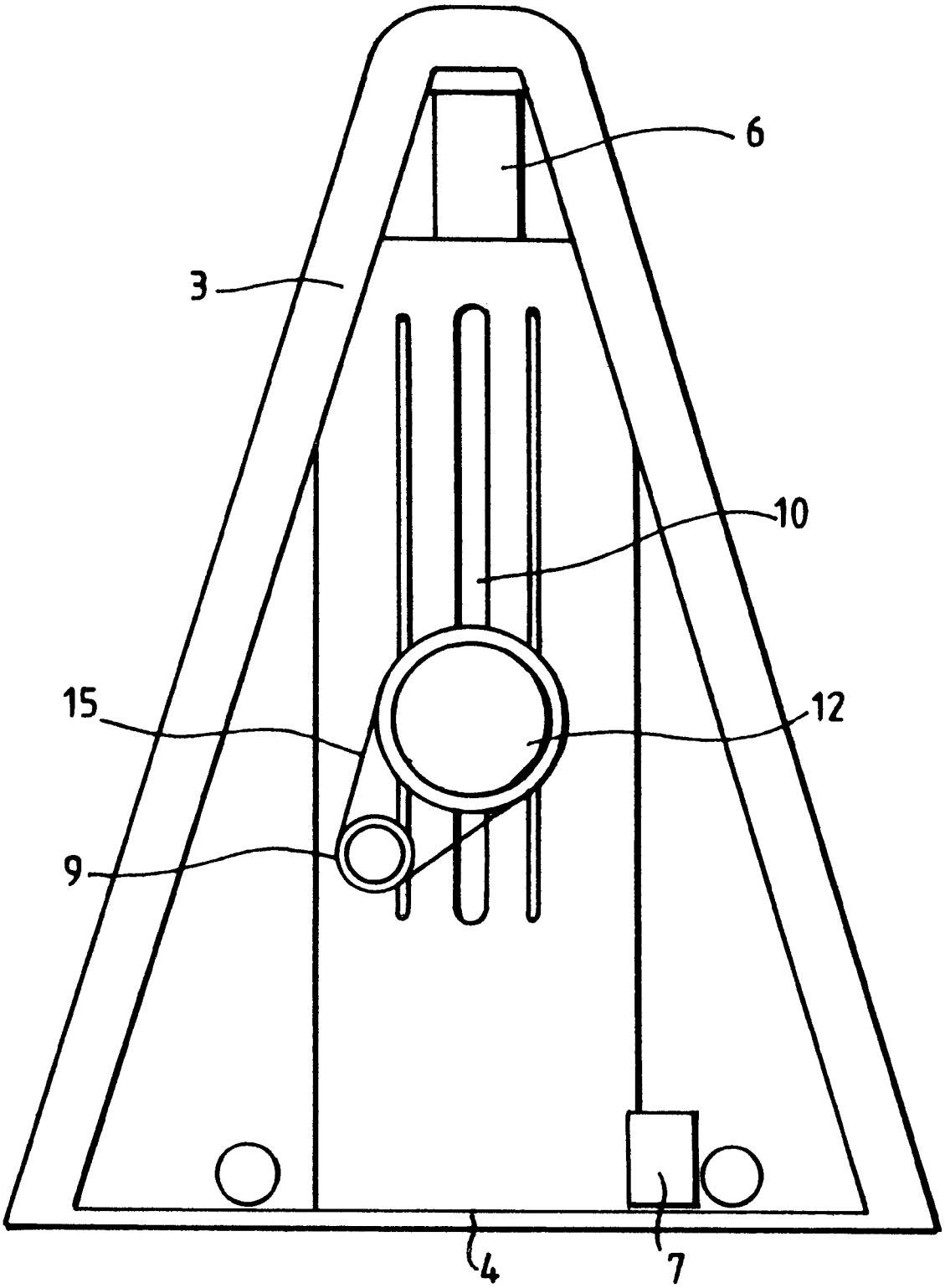
Figure 11A:
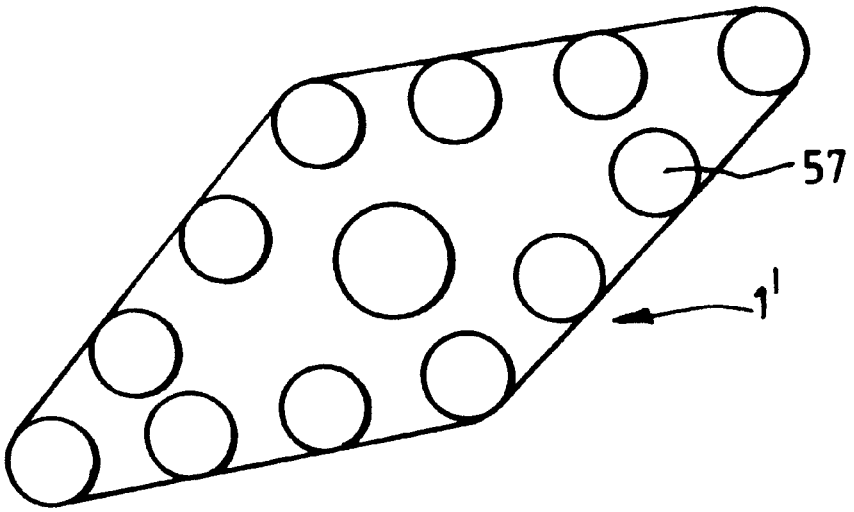
Figure 11B:
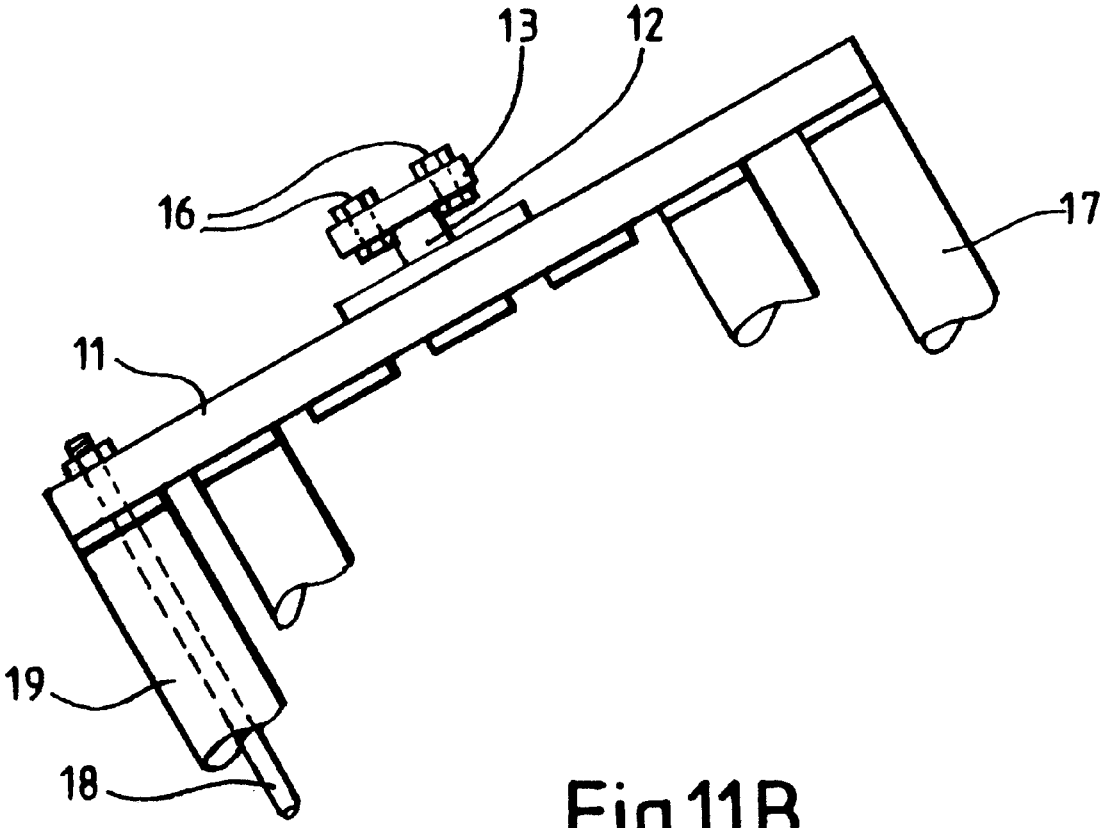

FIG. 5 schematically illustrates a control section for the jump depicted in FIG. 1;

FIG. 6 shows a schematic perspective view of another embodiment of a jump according to the invention;

FIG. 7 schematically illustrates a control section for the jump depicted in FIG. 6;

FIG. 8 shows a schematic perspective view of a further embodiment of a jump according to the invention;

FIG. 9 schematically illustrates a control section for the jump depicted in FIG. 8;

FIG. 10 shows a section through one support of a further embodiment of a jump as depicted in FIG. 1, viewed in direction z, and FIGS. 11A and 11B show a sectional view and a cutaway view respectively, of a further embodiment of a central element of a jump of the type depicted in FIG. 1.

DETAILED DESCRIPTION OF THE PRESENT INVENTION

FIG. 1 shows an embodiment of a jump for horses in which the shape/configuration of the obstacle provided by the jump alters with time. The jump comprises a central element 1, over which the horse jumps, supported by two lateral supports 2. The central element 1 is rotatably mounted with respect to the supports 2, and is caused to rotate by drive means which will be described later. As can be seen from FIG. 3, the central element 1 is elongate in cross-section. Consequently, rotation of this central element 1 alters both the height and edge profile of the obstacle presented to a horse. Thus, the nature of the obstacle will vary with time, providing the rider with a new consideration, namely the most advantageous moment for his horse to tackle the jump in order to clear it.

Figure 2:
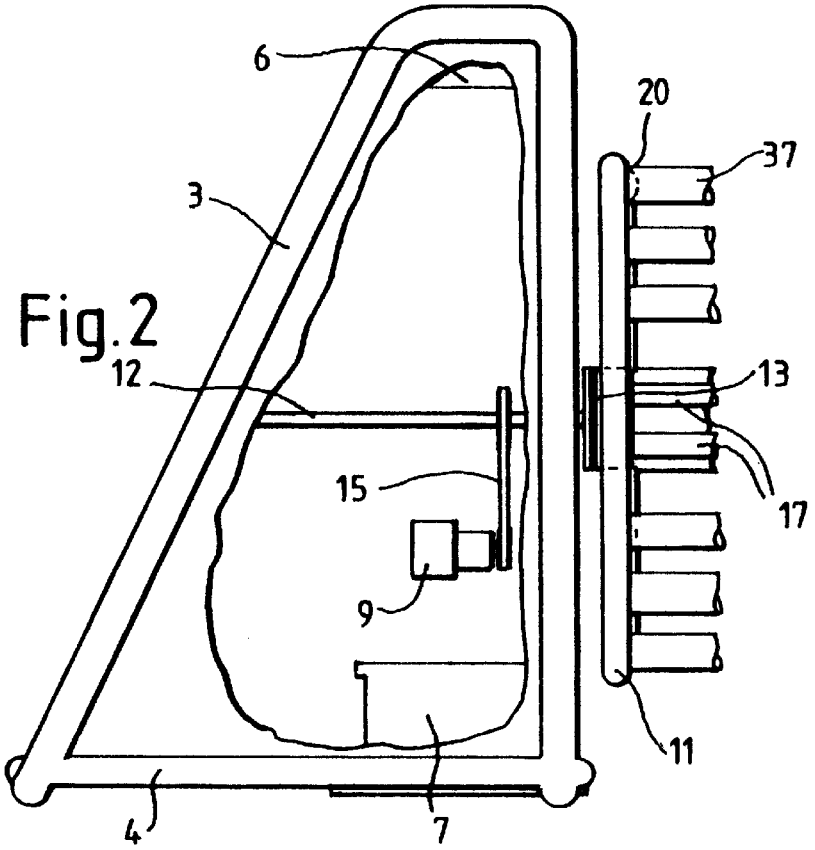
FIG. 2 shows a section through one support of the jump depicted in FIG. 1, viewed in direction y.
Figure 3:
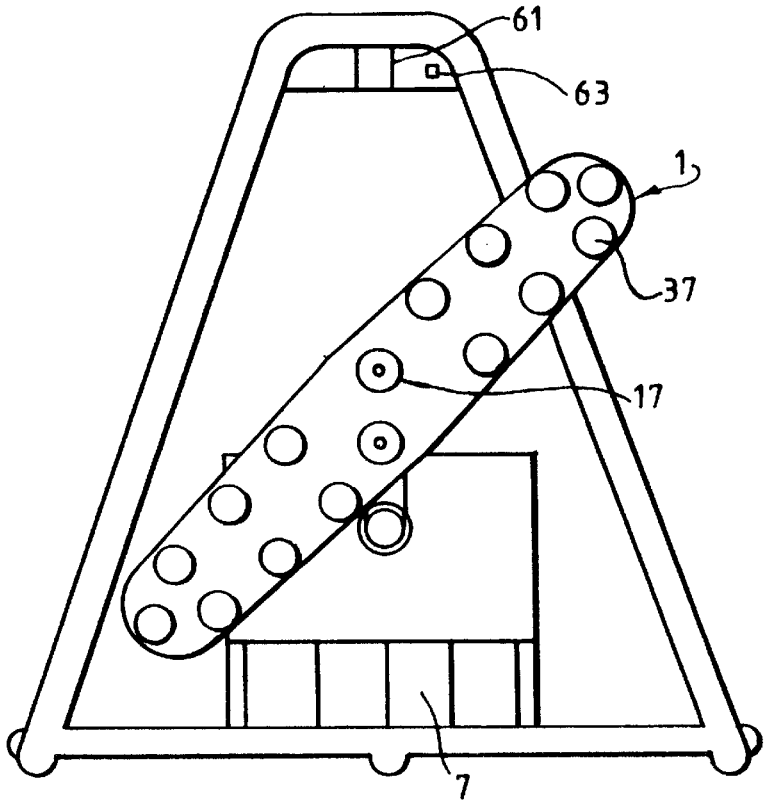
FIG. 3 shows a section through the jump shown in FIG. 1 viewed in direction x, with an access panel of the support removed.
Figure 4:
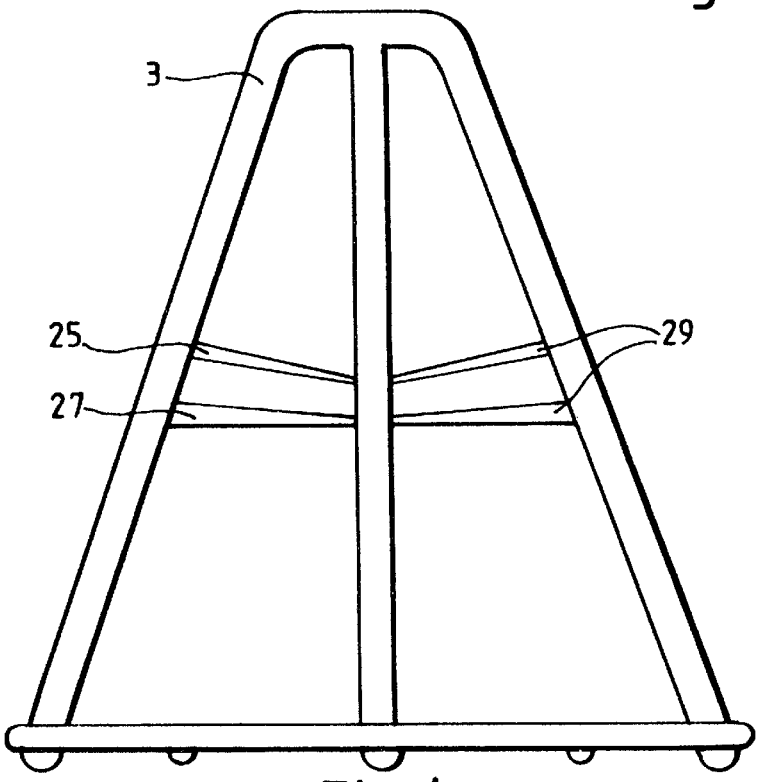
FIG. 4 shows an end view of one of the supports shown in FIG. 1, viewed in direction z.

FIGS. 2, 3 and 4 show one of the supports 2 of the embodiment shown in FIG. 1. Each support 2 comprises a static frame constructed from steel or aluminium tubing covered with dense foam rubber. In this embodiment, each of three limbs 3 extend from an apex to a respective corner of a triangular base plate 4.

Drive means for rotating the central element 1 are provided which comprise a motor 9 powered by batteries 7. In the present embodiment, the motor 9 is a stepper motor (such as, for example, the RS 440464, produced by Radio Shack) whose operation is microprocessor controlled by means of a control section 6. By means of a drive belt 15, the motor 9 drives a drive shaft 12 which is connected to one end of the central element 1. The other end of the central element 1 has an axle which is similarly mounted to the other support 2 but which is not driven.

Two drive flanges 13 respectively link the drive shaft 12 and the axle to the central element 1. These drive flanges 13 are each fixed to the drive shaft/axle by means of shear bolts 16 (see FIG. 11B) of plastics material. These shear bolts are chosen so that they shear for a given impact on the central element 1, allowing the central element 1 to fall to the ground. The central element 1 can then be easily replaced by insertion of further shear bolts to enable the jump to be re-used.

As can be seen from FIGS. 1 and 2, the central element 1 comprises a plurality of poles 17, 37. These are of two types, central poles 17 and outer poles 37. The central poles 17 consist of aluminium tubes with a covering of foam rubber as protection for a horse hitting the pole. These central poles 17 provide the structural strength for the central element 1. If a horse hits these central poles 17 with force, the shear bolts 16 retaining the flanges 13 in position will shear and the central element 1 fall.

The outer poles 37 are conventional showjumping poles, made of PVC which are hollow, and capable of flexure. They are mounted between respective protrusions 20 on opposing plates 11. These protrusions 20 are flexible but resilient: rubber is a suitable choice of material for the protusions 20. The poles 37 are retained on the central element 1 between the protrusions 20, but if a pole 37 is hit firmly by a horse, the resulting flexure of the pole combined with the flexibility of the protrusions is such that the pole disengages from the protrusions and falls to the ground. These outer poles 37 can be simply replaced before the next use of the jump. In most cases where a horse fails to clear the jump, one or more of the outer poles 37 will be knocked loose, but the impact on the central element 1 will not be sufficient to shear the shear bolts 16.

FIG. 4 shows a view of the outer portion of a support 2. Part way up the support are two display strips, each comprising, in this case, a row of light emitting diodes (LEDs). The top row of LEDs 25 comprises ten green LEDs to indicate whether the jump has been attempted and these are triggered by the response of a sensor 63 (shown in FIG. 3). The bottom row of LEDs 27 comprises ten red LEDs for indicating the current physical state of the jump. This state may be the current orientation or rotational speed of the jump, or some other physical parameter providing an indication to a competitor of the current difficulty of the jump. These LEDs are present in order to convey such information to the rider and to the audience. The rows of LEDs are positioned so as to be readily visible to the rider, but without being a distraction to the rider or the horse while a jump is attempted. It is for this reason that the rows are positioned approximately half way up the jump, and are recessed in slits 29 to minimize glare.

FIG. 5 depicts a preferred control section 6 for the jump described above. In this embodiment the control section 6 comprises a microprocessor 14 for control of the stepper motor 9 and a stepper motor driver 36. The microprocessor provides a preprogrammed series of pulses to the stepper motor driver 36 so that the stepper motor drives central element 1 of the jump to rotate with time in a predetermined manner.

The microprocessor 14 is also provided with a number of input and output connections to other circuit components. Two outputs are provided from the microprocessor 14 to a light driver 47 for the red LEDs 27 which indicate the physical state of the jump. These two outputs provide alternative means for driving the red LEDs 27.

One of these outputs from the microprocessor 14 is via a counter 41 which, in this embodiment, is a decade counter. If this output is employed, the decade counter 41 is incremented by signals received from the microprocessor 14 and the light driver 47 receives signals by which the number of LEDs switched on reflects the present value of the decade counter. The signals provided to the decade counter 41 can be, for example, proportional to the number of pulses sent by the microprocessor 14 to the stepper motor 9, with the result that the red LEDs serve to indicate the present rotational orientation of the central element 1. In one mode of operation of the jump, the central element 1 is not continuously rotated, but is driven from one position (for example, that of maximum height) to another position (in this example, that of minimum height), the jump remaining in each of these positions for a set period of time. In this mode of operation, the decade counter 41 is advantageously driven by clock pulses from the microprocessor so that the red LEDs indicate the length of time for which the jump has remained at its present orientation. When this period of time (for example, ten seconds) is completed, the central element 1 of the jump is rotated and the decade counter 41 is reset to zero, as are, in consequence, the red LEDs.

By employing the other of the two alternative outputs from the microprocessor 14 to the light driver 47, via a frequency to voltage converter 67, representation of the rotational speed of the control element 1 can also be achieved. An input signal from the microprocessor 14 to converter 67 which is indicative of the rate at which pulses are provided to the stepper motor driver 36 is converted to a voltage. This voltage is used to drive light driver 47 such that the number of red LEDs illuminated is indicative of the speed of rotation of the central element 1 of the jump.

The ability to select between the two alternative means of operating the light driver 47 enables a choice to be made between different means of operation of the red LEDs 27. If the decade counter 41 is used, the red LEDs can be used to show the position of the obstacle, or to show the length of time that the obstacle has been at its current orientation. If the speed is to be displayed on LED display 27, converter 67 can be employed as the input to light driver 47. Other alternatives are available with appropriate software control of the outputs from microprocessor 14 to the decade counter 41 and frequency to voltage converter 67. A further alternative, not shown, is to employ a second light driver and a further set of LEDs. The first light driver can be driven from the decade counter 41 to display position, and the second light driver can be driven from the converter 67 to display speed.

The availability of a range of possible forms of display on red LEDs 27 is advantageous, as different forms of display will be suitable for different forms of competition. Factors to be considered in determining the appropriate form of display are that it is desirable for the lights to change slowly from one state to another, as "flashing" lights are distracting for horses, competitors, and spectators, and that it is desirable for the information conveyed by the lights to be simple and readily determined from the signal seen.

Operation of the green LEDs 25 is associated with detector 63 which detects when the jump has been attempted. In a preferred embodiment, the detector 63 is constituted by an infra-red thermal detector, which is triggered by the proximity of a horse. In alternative embodiments, other forms of detector can be employed, such as a detector triggered by the breaking of a beam of radiation. When detector 63 is activated, a signal is output by detector 63 to the microprocessor 14 and the green LEDs 25 are illuminated.

In this embodiment, remote control of the microprocessor 14 is provided by means of an infra-red link. Such a link can be of a conventional 14-channel type, such as that commonly used for remote control of televisions. A handheld controller 31 is used in conjunction with an infra-red receiver 33 connected to the microprocessor. Remote control can thus be used to start and/or stop the operation of the jump, and also to reset the jump to a predetermined starting state.

Other components are also mounted to the jump. These further components are not associated with the control section 6, but are powered by means of, or are connected to, the batteries 7. There is a manual switch (not shown) by which the batteries 7 can be taken out of circuit from all components of the jump. A tilt switch (not shown) disables operation of the jump by removal of power to the motor 9 if it senses that the jump has been knocked over. A fan 61 associated with a thermostat is turned on when the jump is powered to cool the electrical and mechanical components of the jump. An automatic fire extinguisher (not shown) is provided which comprises a thermal sensor for activating the extinguisher (for example, a Halon extinguisher) if fire is detected. All these components are employed in other embodiments of jumps according to the invention to be discussed below.

An alternative mounting for the central element is shown in FIG. 10. A track 10 is provided on each support 2 on which the drive shaft and axle are mounted by means of bearings. The tracks 10 enable alteration of the height of axle and drive shaft 12 together with the entire motor assembly. In the embodiment depicted in this figure, the motor and axle assembly is fixed in the tracks 10 with respect to the supports 2 by means of lockable hex studs which permit manual height adjustment. In further embodiments, a second motor assembly is provided to move the axle and motor assembly up and down the tracks 10 enabling, in addition to the alteration with time of the obstacle presented by the jump through rotation of the central element 1, alteration with time of the axial height of the obstacle which the central element 1 presents during jumping. Alternatively, a hydraulic ram is provided in one or both supports for controllable height adjustment of the motor assembly and central element 1.

FIGS. 11A and 11B show another embodiment of a central element 1' of the jump. The central element 1' in this embodiment is of a substantially rhomboid shape. The outer poles 57 are of a different form from outer poles 37 depicted in FIG. 2. These poles 57 have a central metal core 18, advantageously a spring steel rod, with an outer sheath formed by a polyethylene tube 19. In a preferred form of this embodiment, the metal rod 18 is part of an electrical circuit and metal conductors are provided on the internal surface of the polyethylene tube 19 to provide a "touch indicator". With this arrangement, when a horse touches a pole 57, the polyethylene tube 19 is pressed towards the central rod 18 and the conductors on the internal surface of the tube 19 make electrical contact with the rod 18 to activate a visual and/or audio indicator directly. Alternatively, the electrical signal resulting from contact of a horse with a "touch indicator" may be sent to a control circuit (not shown) associated with the microprocessor 14 in the control section 6 of the jump. This provides an alternative means of assessing a penalty to observing whether or not the central element 1, or a part of the central element 1, has fallen.

Outer poles 57 of this type are not mounted so that they can be dislodged from the central element 1', but are rigidly mounted to the plate 11. The outer poles 57 also provide structural strength to the central element 1', and in consequence all poles of central element 1' may be of this type.

Such a "touch indicator" arrangement can also be employed advantageously in conventional jumps which do not change their shape or configuration. Poles 57 for such touch indicators can be manufactured by inserting stainless steel wires and adhesive into a polyethylene tube 19 and pushing a mandrel through the central core to force the wires and adhesive onto the internal surface of the tube 19, before inserting the metal core 18.

As already mentioned, the embodiment described with reference to FIGS. 1 to 5 has a central element whose cross section is elongate, whereas that shown in FIG. 11A is substantially rhomboidal. While a generally elliptical cross-sectional shape is preferred it will be appreciated that other cross-sectional shapes are available for providing a jump which will vary in respect of the shape and/or configuration which it presents to the horse, and further that the cross-section of the central element 1, 1' may vary along its length. In addition, it is not essential that this central element 1, 1' be mounted on a central axis and, consequently, this element may comprise an eccentrically mounted cylinder.

FIG. 6 illustrates another embodiment of a jump according to the invention. This jump has means for moving the jump itself along the ground as well as changing the shape and configuration of the obstacle provided. It comprises a central section 21 with a plurality of poles 24 for the horse to jump over. These poles are mounted to two lateral supports 22 along a portion only of the periphery of the supports 22. Each support 22 comprises a track 23 along its periphery which is driven by a drive wheel 81 connected to the track by an internal toothing 82. Such an arrangement of drive wheels, with additional non-driven (i.e., idler) wheels, allows the supports 22 to move as a whole along the ground in a manner similar to how a tank moves along the ground. In this preferred embodiment each support has a respective motor 9' to drive this motion and each has a gearbox and reduction gearing to enable matching of the speeds of the two supports.

In the embodiment depicted in FIG. 6, poles 24 are mounted to the tracks 23 by means of L-shaped brackets attached to the inner surface of tracks 23 with protrusions, of the same form as protrusions 20 employed in the first embodiment and shown in FIG. 2, for accepting an end of a respective pole 24. On impact by the horse, flexure of a pole 24 and the flexibility of the protrusions results in the disengagement of the pole from the protrusions.

In a preferred alternative embodiment a flange mounting is provided on each L-shaped bracket to which the ends of the poles 24 are connected by means of plastics shear bolts in a manner similar to that shown in the FIG. 1 for connecting the axle element 12 with the central element 1 by means of flange 13. In this case the poles 24 may be the same form as poles 37 of the embodiment shown in FIGS. 1 to 5.

FIG. 7 depicts a control section 6' for the jump of FIG. 6. The arrangement is largely the same as that depicted in FIG. 5 for the jump of FIG. 1, and the same reference numerals are employed where appropriate. In this case, there are two stepper motors 9', as this embodiment requires each of the two tracks 23 to be driven by its own motor.

It will be appreciated that as the tracks 23 are driven not only does the jump advance along the ground but the length and height of the obstacle formed by the poles 24 will change. A typical range of motion for the jump along the ground would be of the order to 6 meters during a show-jumping round of approximately 90 seconds.

In another embodiment employing tracks the each pole 24 is fixed with respect to the supports 22 rather than being driven with the tracks 23. In this case, the obstacle remains fixed in shape and configuration while the jump moves relative to the ground.

FIG. 8 shows a further embodiment of a jump which has means for changing the shape and configuration of the obstacle provided. The jump comprises two lateral supports 42 and a sealed base section 43 forming a sump. Within one of the two lateral supports 42 is a water pump 45 powered by means of a battery and controlled by means of a control section 6'. The supports 42 also comprise a plurality of water jet nozzles 44 through which water is pumped by the pump from sump 43. These nozzles 44 are advantageously mounted within a frame structure consisting of heavy rubber sheeting stretched over solid rubber rollers with spring steel cores. It is desirable for the whole framework of the jump to be cased in rubber for reasons of safety and to retain the water.

The output of water from nozzles 44 is controlled from the control section so as to vary the shape and/or configuration of the obstacle presented to the horse. This is advantageously achieved by use of solenoid valves 54 at each nozzle 44 so that the nozzle can be opened or closed in response to a signal from the control section. In one embodiment, the switching of the individual water nozzles between open and closed may be controlled so that the nozzles are progressively opened to the passage of water at progressively greater heights. Alternatively, or in addition, the flow aperture and pressure at individual nozzles can be varied by regulating valves thereby allowing the volume and force of water passing through the nozzles to change with time.

A control section 6" for the jump depicted in FIG. 8 is shown in FIG. 9. The arrangement depicted is similar to that shown in FIG. 5 and discussed above, and again the same reference numerals are used where appropriate. The rotary solenoid water valves 54 are driven through a decade counter 41 in accordance with the control program in the microprocessor 14 of the control section 6". Signals are also provided to the light driver 47, which drives spotlights 55 which illuminate the stream of water issuing from the nozzles 44. The operation of the motor of the water pump 45 is controlled by control section 6" via motor driver 36".

Jumps such as those described above permit new forms of showjumping competition providing greater interest for riders and spectators while maintaining or improving the safety of horses and riders. As has been described above, remote control of the jumps can be coupled with automatic control to drive the jumps according to a pre-set plan. Alternatively, with appropriate control, instructions for the jump can be determined remotely and transmitted through the remote control to the jump, so the jump control unit itself does not provide preprogrammed control of the change of shape, configuration, or position of the jump.

In competitions employing such jumps, a competitor's round may start with the motors of the jumps set into operation while the jumps are at their "easiest" positions. With movement of tracks 23, the jump of the embodiment shown in FIG. 6 will change configuration such that the poles 24 which initially all lay along the ground, are progressively lifted, increasing the height of the jump, and changing its length. Likewise, in the FIG. 8 embodiment, water jets can be progressively switched on to increase the height of the obstacle provided by the jump from zero to the height of the highest jet. A jump such that in FIG. 1 would require careful timing on the part of the rider, as it would be easier to jump at one point in its rotational cycle than at another. The change in shape, configuration, or position of the jump can be made discontinuous, in the sense that it takes place in discrete steps so that a rider has a period of time to attempt a jump at a particular level of difficulty, or it can be made continuous, so that a jump becomes progressively more difficult, or progressively easier, with time. Thus, jumps of this kind exercise a considerable challenge to the skill of the rider in choice of route and/or timing of approach because of their continuously changing rather than static nature. Enjoyment of all participants in and spectators of showjumping competitions of this kind should therefore be greatly increased.

I claim:

1. A jump for horses comprising:

an obstacle over which a horse is to jump; said obstacle supported between a pair of upright supports; and control means for altering the obstacle, the control means automatically altering at least one of the shape, configuration and position relative to the ground of the obstacle in a predetermined manner prior to a jump by the horse to present different obstacles to the horse over a predetermined period of time.

2. A jump according to claim 1, wherein the control means automatically alters the obstacle in a stepwise manner.

3. A jump according to claim 1, wherein the control means alters the obstacle in a continuous manner.

4. A jump according to claim 1, wherein the control means alters the obstacle in a cyclical manner.

5. A jump according to claim 1, wherein the obstacle presented by the jump to the horse comprises at least one selectable obstacle element, wherein the selection of one of the presence and absence of the obstacle of each of said selectable obstacle element is determinable by said control means.

6. A jump according to claim 1, further comprising a plurality of water jet nozzles from which water issues to constitute said obstacle.

7. A jump according to claim 6, further comprising valve control means for selectively controlling issue of water from said water jet nozzles.

8. A jump according to claim 1, further comprising an elongate element, and drive means for rotating said elongate element about an axis thereof, wherein a cross-section of the elongate element normal to said axis is non-circular centered about said axis so that rotation of said element about said axis alters at least one of the shape and configuration of the obstacle presented to the horse.

9. A jump according to claim 8, wherein said element is non-circular in cross-section.

10. A jump according to claim 9, wherein said element is eccentrically mounted.

11. A jump according to claim 1, further comprising means for altering the vertical height of said obstacle presented by the jump.

12. A jump according to claim 1, further comprising means for altering the horizontal position relative to the ground of the obstacle presented by the jump to the horse.

13. A jump according to claim 12, further comprising a plurality of mutually parallel elongate elements defining said obstacle, and drive means for moving said elements in a direction perpendicular to their length along a closed loop, said closed loop moving along the ground.

14. A jump according to claim 1, wherein said control means comprises a programmable controller unit.

15. A jump according to claim 14, wherein the controller unit is located remote from the jump.

16. A showjumping circuit comprising:

a plurality of jumps for horses, each of said jumps including an obstacle over which a horse is to jump, each of said jumps further comprising control means for altering the obstacle, the control means automatically altering at least one of the shape, configuration and position relative to the ground of the obstacle in a predetermined manner prior to a jump by the horse to present different obstacles to the horse over a predetermined period of time.

17. A method of operating a jump for horses comprising the step of:

automatically altering in a predetermined manner prior to a jump by a horse at least one of the shape, configuration, and position relative to the ground of an obstacle over which the horse is to jump to present different obstacles to the horse over a predetermined period of time.

18. A method according to claim 17, wherein the obstacle presented by the jump is altered in a stepwise manner.

19. A method according to claim 17, wherein the obstacle presented by the jump is altered in a continuous manner.

20. A method according to claim 17, wherein the obstacle presented by the jump is altered in a cyclical manner.

21. A jump for horses comprising:

an obstacle over which a horse is to jump; said obstacle supported between a pair of upright supports; and control means for altering the obstacle, the control means automatically altering at least one of the shape, configuration and position relative to the ground of the obstacle in a predetermined manner to present a series of different obstacles during different jumps by the horse.

* * * * *